US007364319B2

(12) United States Patent
Canella

(10) Patent No.: US 7,364,319 B2
(45) Date of Patent: Apr. 29, 2008

(54) BATTERY-POWERED LIGHT

(76) Inventor: Robert L. Canella, 1323 Virginia Cir., Nampa, ID (US) 83687

( * ) Notice: Subject to any disclaimer, the term of this patent is extended or adjusted under 35 U.S.C. 154(b) by 140 days.

(21) Appl. No.: 11/246,449

(22) Filed: Oct. 6, 2005

(65) Prior Publication Data

US 2006/0077655 A1 Apr. 13, 2006

Related U.S. Application Data

(60) Provisional application No. 60/616,910, filed on Oct. 7, 2004.

(51) Int. Cl.
*F21L 4/00* (2006.01)

(52) U.S. Cl. ..... 362/158; 362/205; 362/398

(58) Field of Classification Search ..... 362/158, 362/200, 205, 276, 183, 394, 398, 802
See application file for complete search history.

(56) References Cited

U.S. PATENT DOCUMENTS 3,794,825 A * 2/1974 Krupansky ..... 635/158
5,535,107 A * 7/1996 Prok ..... 362/158
6,280,049 B1 * 8/2001 Tam ..... 362/158

* cited by examiner

*Primary Examiner*—John Anthony Ward
(74) *Attorney, Agent, or Firm*—TraskBritt

(57) ABSTRACT

A personal light including a battery power source connected in series with a light-emitting diode (LED) light source and a switching mechanism configured for non-contact actuation are disposed within an environmentally sealed chamber. A reflector is employed to maximize reflection of light emanating from the LED and a lens having an anti-reflective coating thereon associated with the LED opposite the reflector to enhance the light output and magnify the narrow beam of the LED. The switch employs an actuation mechanism exterior to the chamber to activate and deactivate the light.

22 Claims, 8 Drawing Sheets

BATTERY-POWERED LIGHT

CROSS-REFERENCE TO RELATED APPLICATION

This application claims the benefit of U.S. Provisional Patent Application Ser. No. 60/616,910, filed Oct. 7, 2004, the disclosure of which is incorporated herein in its entirety.

BACKGROUND OF THE INVENTION

The present invention relates generally to portable lights and, more specifically, to personal lights employing a non-contact switch actuating mechanism operable to control actuation of a light source powered by at least one battery, the light source and battery being completely physically isolated from an actuating portion of the switching mechanism in a sealed housing.

BRIEF SUMMARY OF THE INVENTION

The present invention comprises a compact, battery-powered light, which may be of cuboidal configuration. The term "cuboidal," as used herein, does not necessarily denote a perfect cube, but a three-dimensional shape generally defined by rectangular sides at mutually perpendicular angles. The size of the light may be optimized for a particular number and series of batteries, and to optimize yield in terms of material usage. Light is output from a face of the light rather than from an end, as in conventional, substantially tubular, battery-powered lights.

In one embodiment, the light may be designed to function at a selected voltage through a current-limiting device connected in series with a battery power source, a light source comprising a light-emitting diode (LED) and a switch with a non-contact actuating mechanism. A suitable reflector may be employed to maximize reflection of light emanating from the LED, and a magnifying lens may be associated with the LED opposite the reflector to enhance the light output and magnify the narrow beam of the LED. A switch using a non-contact actuator, such as Hall-effect-type magnetic reed switch, may be used to activate and deactivate the light, rather than a conventional, contact-type switch which is susceptible to wear and corrosion. At least the LED, battery and switch are environmentally isolated within a chamber in the light housing, the reed switch being responsive to the presence or absence of a magnetic field in close proximity thereto exterior to the chamber and provided by a movable element bearing at least one magnet. Thus, the light may be fabricated to exhibit a high water resistance, even under increased pressure, as well as being suitable for use in potentially explosive environments such as mines and certain manufacturing facilities wherein fumes or vapors may be highly susceptible to ignition from a spark associated with actuation of a conventional contact-type switch.

A machine-angled edge may be provided at a back corner or along a juncture of a back surface and a bottom surface of the light to enable positioning thereof on a surface to present the light beam at an upward angle. A tapped hole may be provided on each of several surfaces of the light to enable mounting the light on a stand or tripod, attaching an accessory such as a belt clip or a carabiner clip to the light, or positioning the light on a helmet, head strap or body harness. A hole cross-drilled through the light body from one exterior surface to another thereof may be provided for attachment of a lanyard, which may be used for a wrist strap or a tie for a belt or strap. The lanyard may aid in the overall ergonomic shape of the light and it fits in the palm of a user's hand when carried by attachment to the wrist.

The light size and shape may be optimized to provide comfort, portability and usefulness to the user due to its convenient size and shape format. For example, the size and shape may provide easy handling of the light in the palm of one's hand. All sharp edges and corners of the light may be chamfered to provide for a comfortable fit into the hand, reducing discomfort when the light is held for long periods and avoiding abrasion of the hand and other skin surfaces.

DETAILED DESCRIPTION OF THE ILLUSTRATED EMBODIMENTS

Figure 1A:
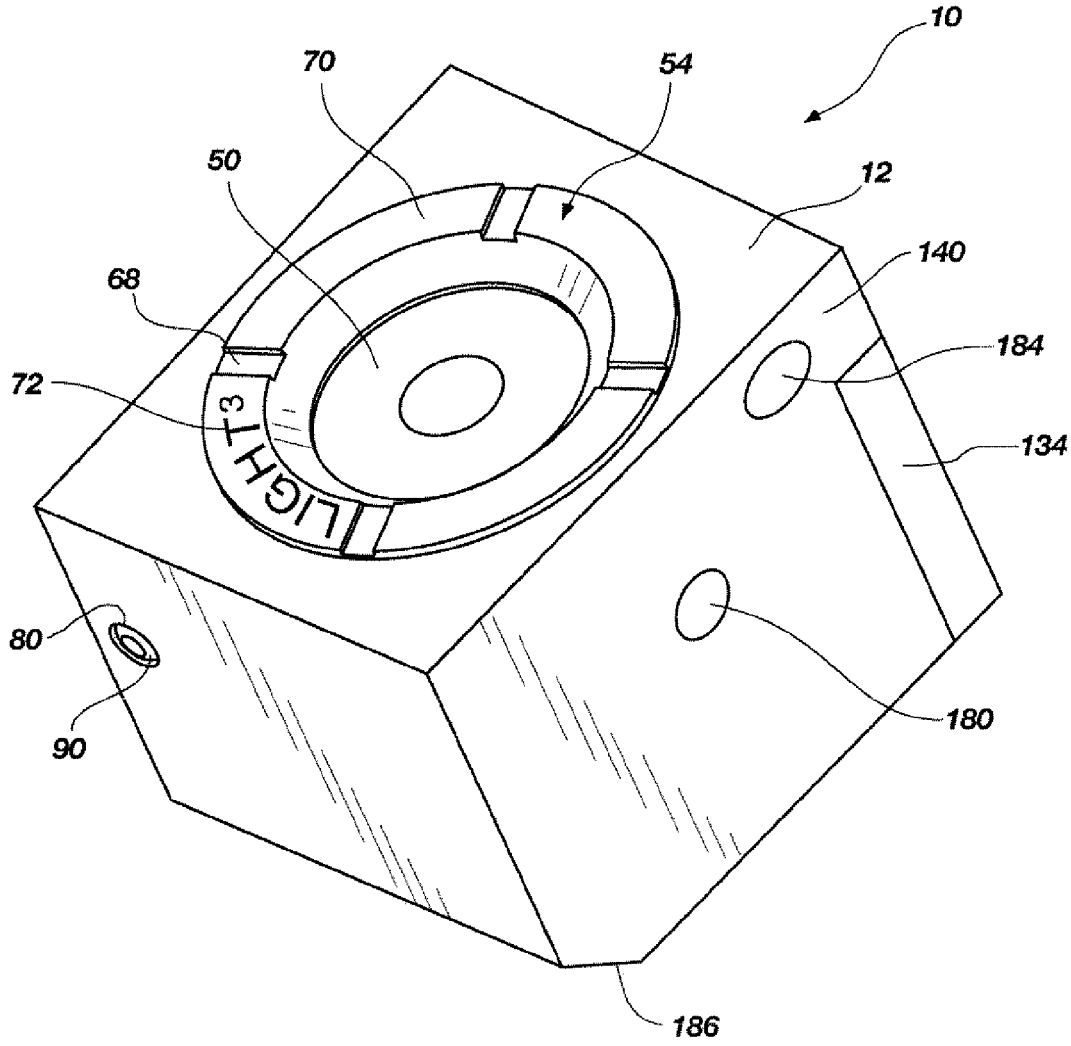
FIGS. 1A through 1D are exterior, perspective views of a battery-powered personal light of the present invention.
Figure 1B:
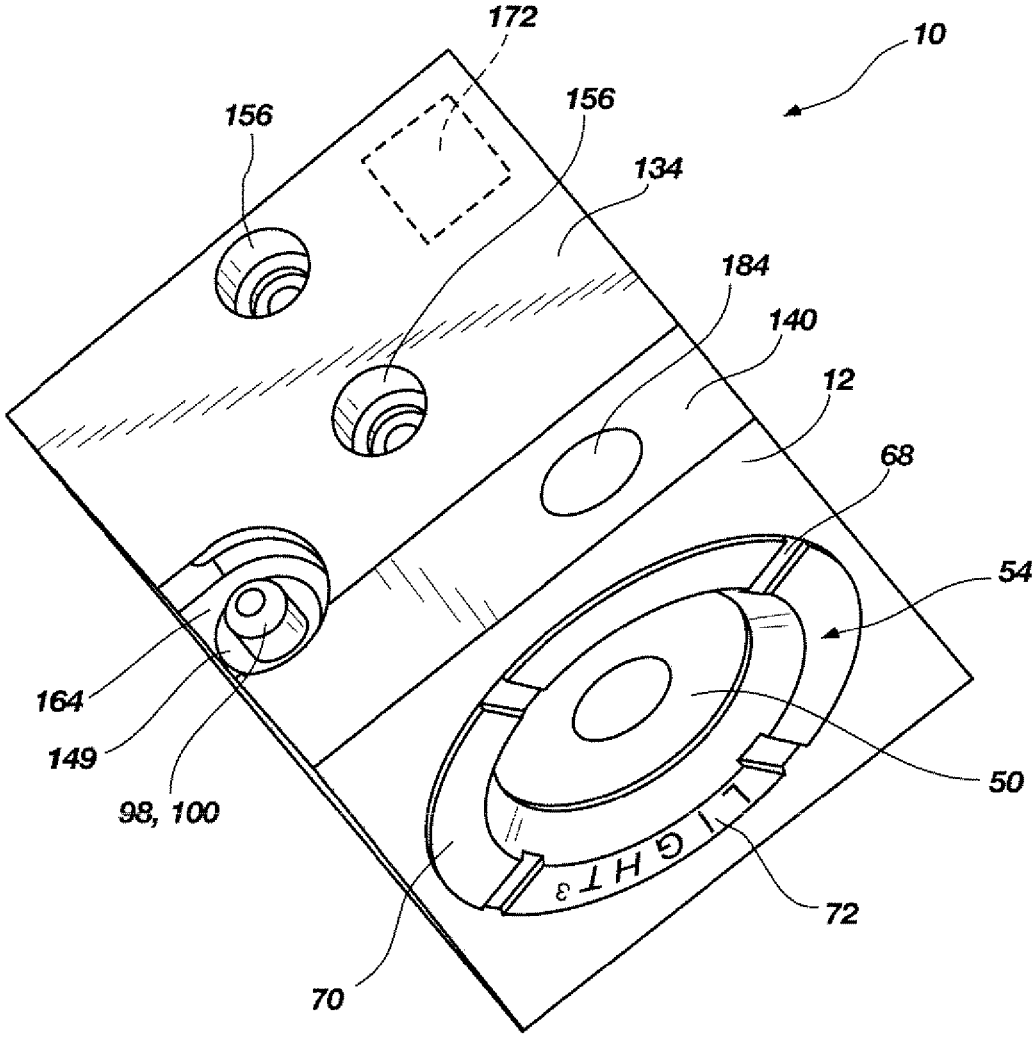
Figure 1C:
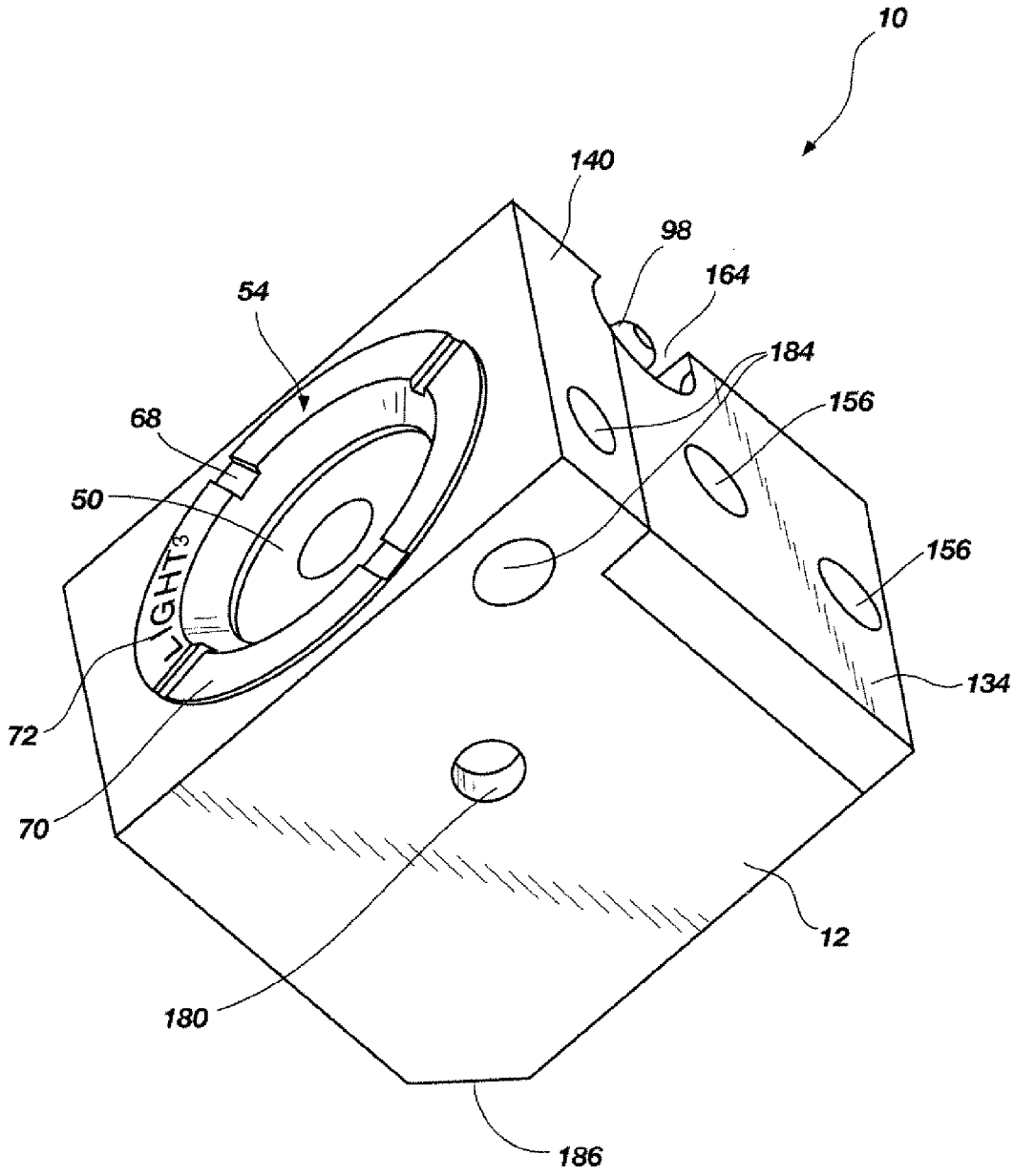
Figure 1D:
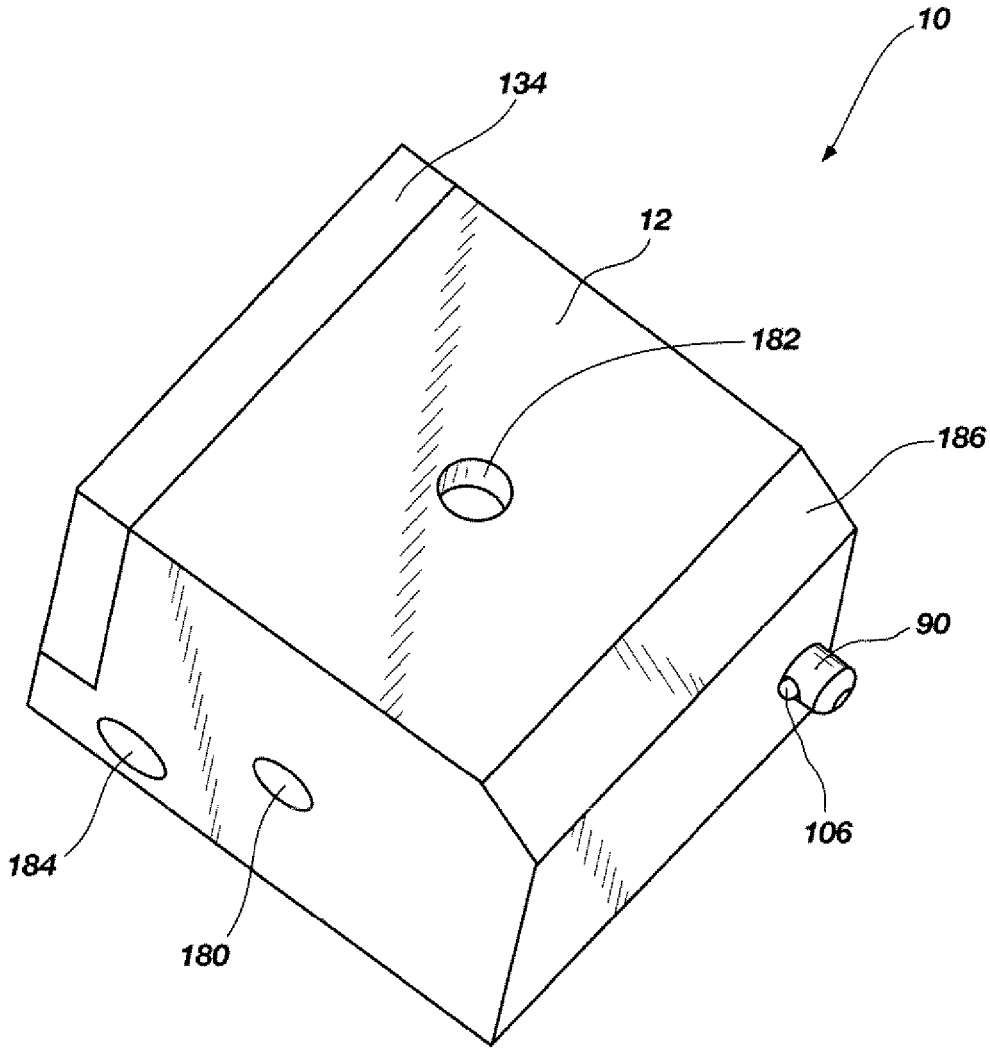

Referring to the drawing figures, the present invention comprises a battery-powered personal light 10 comprising a housing 12, which may be of cuboidal configuration. Housing 12 is preferably formed from a single blank of relatively lightweight material, such as, for example, a metal or a resin. If formed of a metal, aluminum may be a suitable selection for the housing, as it is lightweight, easily machinable and offers good heat transfer properties, the desirability of the latter being apparent from the further discussion of the invention below.

Figure 2:
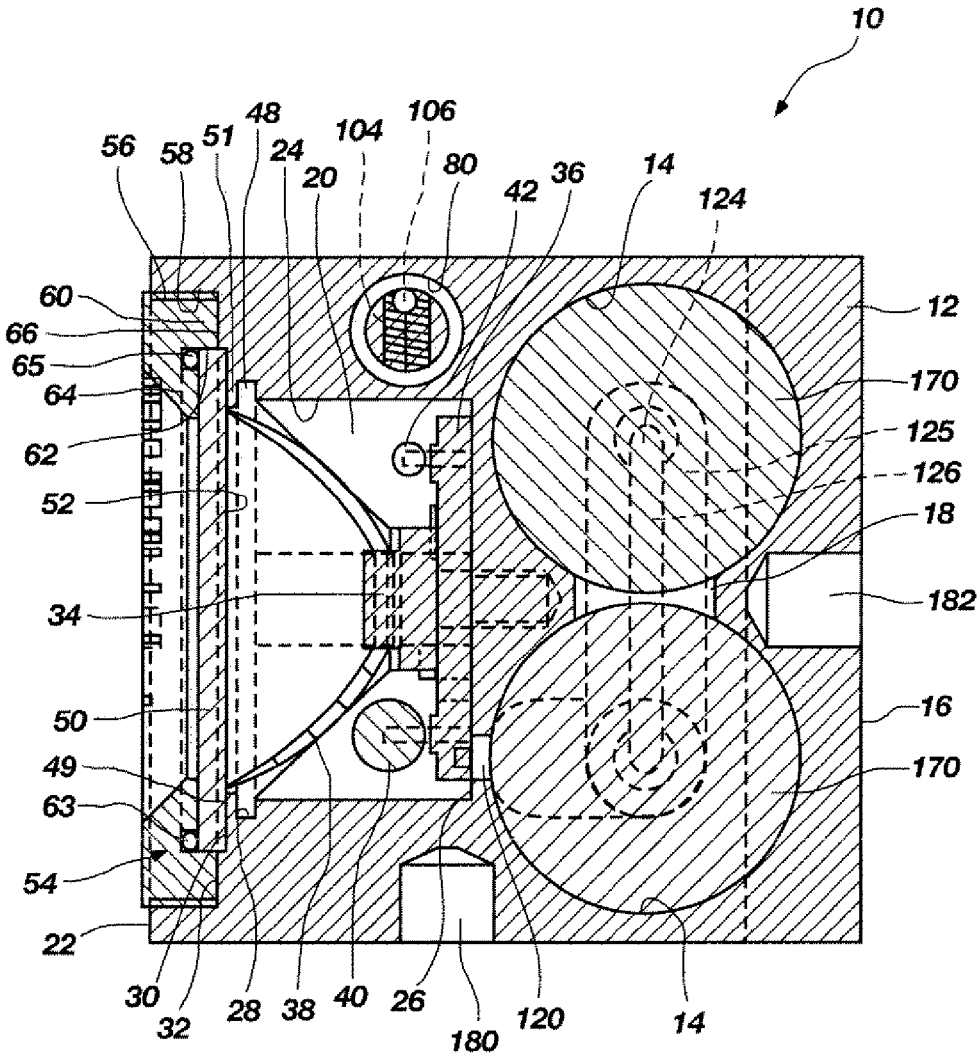
FIG. 2 is a transverse, horizontal cross-section through the battery-powered personal light.

As depicted in FIG. 2, housing 12 may include twin circular battery bores 14 therein, offset toward exterior rear surface 16 of housing 12 for receiving two batteries. Battery bores 14 are laterally connected by aperture 18, which may be milled through the material of housing 12 after battery bores 14 are formed. A larger, cylindrical lighting bore 20 may be formed in housing 12 transverse to battery bores 14 and centered on the face of the exterior front surface 22 of housing 12 through which aperture 18 is formed. Lighting bore 20 includes an elongated bore wall 24 terminating inwardly at a substantially flat bore base 26 and outwardly at stepped annular recesses 28, 30 and 32 of ever-greater inner and outer diameters.

A light-emitting diode (LED) 34 mounted to a circuit board 36 and having a reflector 38 disposed thereabout and extending distally therefrom is disposed within lighting bore 20. Reflector 38 may exhibit a parabolic profile or, alternatively, a dual angle parabolic/linear (in cross-section) profile. A current-limiting device 40 and a switch 42 configured for use with a non-contact actuating mechanism may be mounted to circuit board 36 to either side of LED 34. This assembly is disposed within lighting bore 20 and aligned and secured therein by fasteners such as screws 44, engaging threaded bores 46 (see FIG. 3) formed through bore base 26.

LED 34 may be a high output (brightness) white LED such as a Luxeon® 1W LED (Lumileds Lighting, San Jose, Calif.) having relatively high efficiency for extended battery life. Nichia America Corporation, Mountville, Pa., also offers suitable high output (brightness) LEDs, as do other manufacturers. LEDs are very efficient compared to filament-type lamps, and offer high output and enhanced reliability, with operating lives approaching 100,000 hours. Reliability of such LEDs is enhanced by mounting to a heat-dissipative carrier, so circuit board 36 may be a thermally conductive circuit board with an aluminum back, for example, to act as a heat sink and transmit heat to (in this embodiment) the aluminum of housing 12. If housing 12 is formed of a poor thermal conductor such as a resin, a heat sink plug (not shown) of suitable metal may be molded into the housing and placed in thermal contact with the LED through circuit board 36.

Reflector 38 may exhibit a mirror finish and an associated highly reflective coating, such as elemental aluminum, to optimize light output of LED 34. There is also technology available from Fraen Corporation of Reading, Mass., for plastic injection molding of a reflector having a reflective surface as formed.

An outer rim 48 of reflector 38 is received within stepped annular recess 28. A lens 50 of greater diameter than that of outer rim 48 is disposed thereover, and the outer periphery of lens 50 is received within annular recess 30, with a portion of lens 50 projecting outwardly therefrom (along the axis of reflector 38) into annular recess 32. Lens 50 may comprise, for example, a sapphire lens, a mineral crystal lens or a polycarbonate lens. The lens 50 may be configured at least partially with an area of magnification to amplify light emanating from LED 34 and project it forward in the form of a focused beam, and the interior surface of lens 50 may be coated with an anti-reflective coating 52 to improve light transmission therethrough.

An annular lens cap 54 with a threaded periphery 56 may be disposed within annular recess 32 and secured to internal threads 58 at the periphery of annular recess 32. Lens cap 54 includes annular protrusion 60 along the periphery thereof, annular protrusion 60 having an inner edge 62 of slightly greater diameter than an outer diameter of lens 50 so as to extend over the outwardly projecting portion of lens 50 and center it within annular recess 30. Annular foot 64 lies radially inward of annular protrusion 60 and is of lesser inward extent, so as to contact the outer face of lens 50 and gently and uniformly press lens 50 against the outer rim 48 to fix same in place against vibration, and to seat the periphery of lens 50 against the floor 66 of annular recess 32. Elastomeric O-rings 51 and 65 may be respectively disposed in annular recess 49 of reflector rim 48 and annular recess 63 between annular protrusion 60 and annular foot 64 of lens cap 54 to provide a water- and vapor-tight seal for cylindrical lighting bore 20, as the lens 50 is sandwiched between the O-rings 51 and 65. Suitable materials for O-rings 51 and 65 include buna-N (nitrile) and fluorocarbon (such as Viton®) elastomers. As is evident from FIG. 1A, lens cap 54 may include radially extending slots 68 in the exterior face 70 thereof, by which lens cap 54 may be rotated to move inwardly to press against lens 50 and be secured to housing 12. Further, radially extending slots 68 provide outlets for light transmitted through lens 50 when LED 34 is powered and personal light 10 is placed, for example, on a flat surface with exterior front surface 22 face down. Finally, lens cap 54 provides a suitable surface for engraving of a product name, logo or other graphic as shown at 72.

Referring again to FIG. 2, a circular switch actuator bore 80 is formed in housing 12 parallel to circular battery bores 14 and to one side of lighting bore 20. As may best be seen in FIG. 3, circular switch actuator bore 80 includes a first bore portion 82 of a first diameter and a second counterbore portion 84 of relatively greater diameter. A coil spring 86 of an inner diameter greater than that of first bore portion 82 and an outer diameter less than that of second counterbore portion 84 is disposed in second counterbore portion 84 and rests on annular floor 88 at the base of second counterbore portion 84. Switch actuator rod 90 is disposed in switch actuator bore 80, a first portion 92 thereof of lesser diameter being received in first bore portion 82 and a second portion 94 thereof of greater diameter being received in second counterbore portion 84, coil spring 86 thus being received within a spring chamber 96 defined between housing 12 and switch actuator rod 90. An end portion 98 of switch actuator rod 90 of lesser diameter than second portion 94 and having rounded end periphery 100 is located on switch actuator rod 90 opposite first portion 92. Transverse spring bore 102 at the end of switch actuator rod 90 opposite end portion 98 has compressed coil spring 104 disposed therein (although, for example, an elastomer spring is also suitable), biasing detent ball 106 outwardly through ball retention aperture 108 coaxial with, but of smaller diameter than, transverse spring bore 102, which is closed at its opposite end as, for example, by deforming or pruning the spring entry mouth of spring bore 102 after coil spring 104 is disposed therein. Detent ball 106 may be oriented in any circumferential direction, for example in a direction opposite that depicted in FIG. 3, or otherwise. Permanent magnets 112 and 114, which may comprise (by way of example only) Neodymium, Samarium Cobalt, or AlNiCo magnets, are disposed within magnet chamber 116 formed within second portion of switch actuator rod 90 for use in actuation of switch 42, as described below. As may be seen in FIG. 3, switch actuator rod 90, which may be, for example, of brass, is formed in two parts each providing a cavity holding a permanent magnet 112 and 114, respectively, the two parts joining along line 118 to form magnet chamber 116 and being held together by the magnetic fields of permanent magnets 112 and 114.

Figure 3:
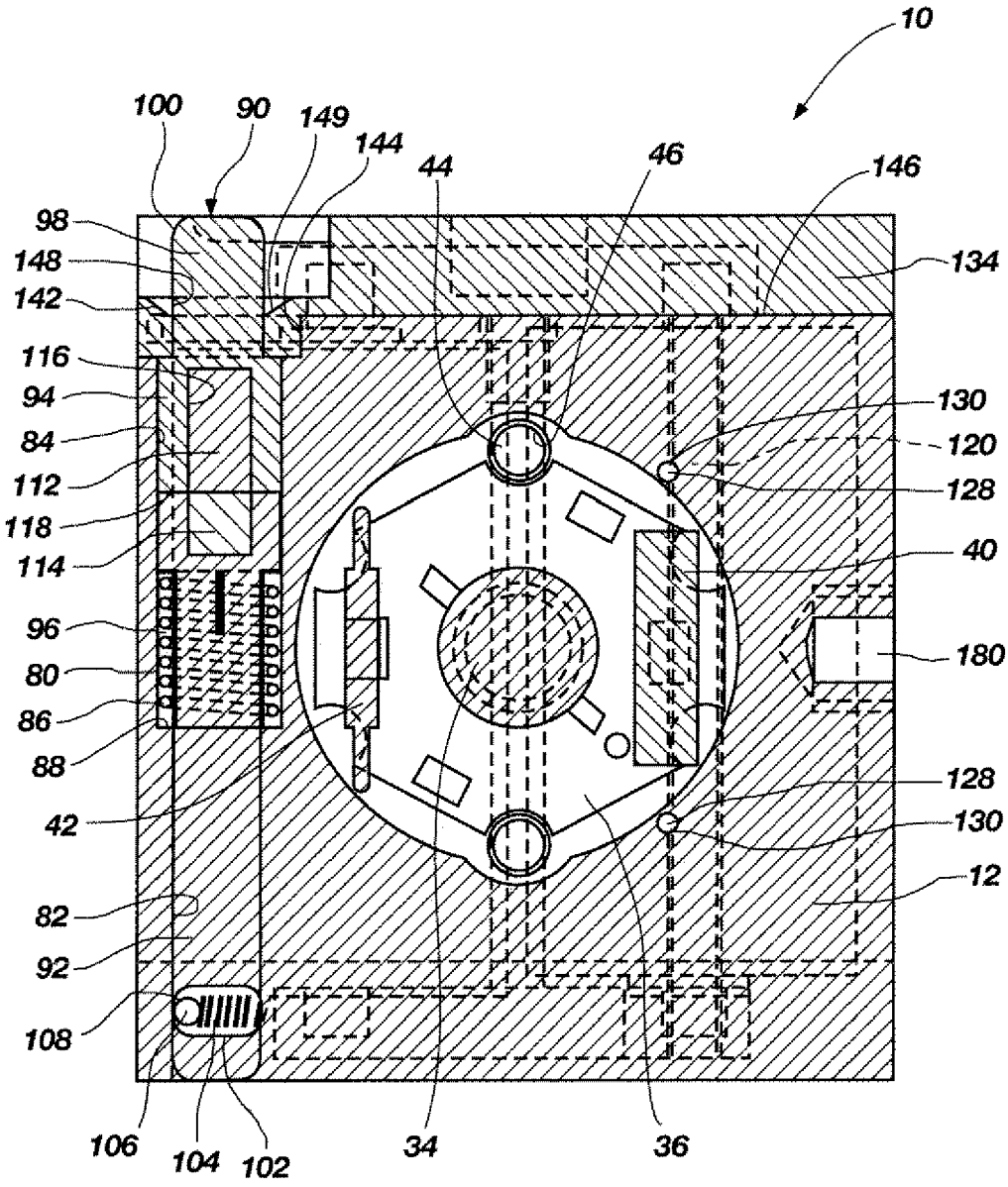
FIG. 3 is a transverse, vertical cross-section through the battery-powered personal light, taken through the location of a non-contact switch thereof.
Figure 4:
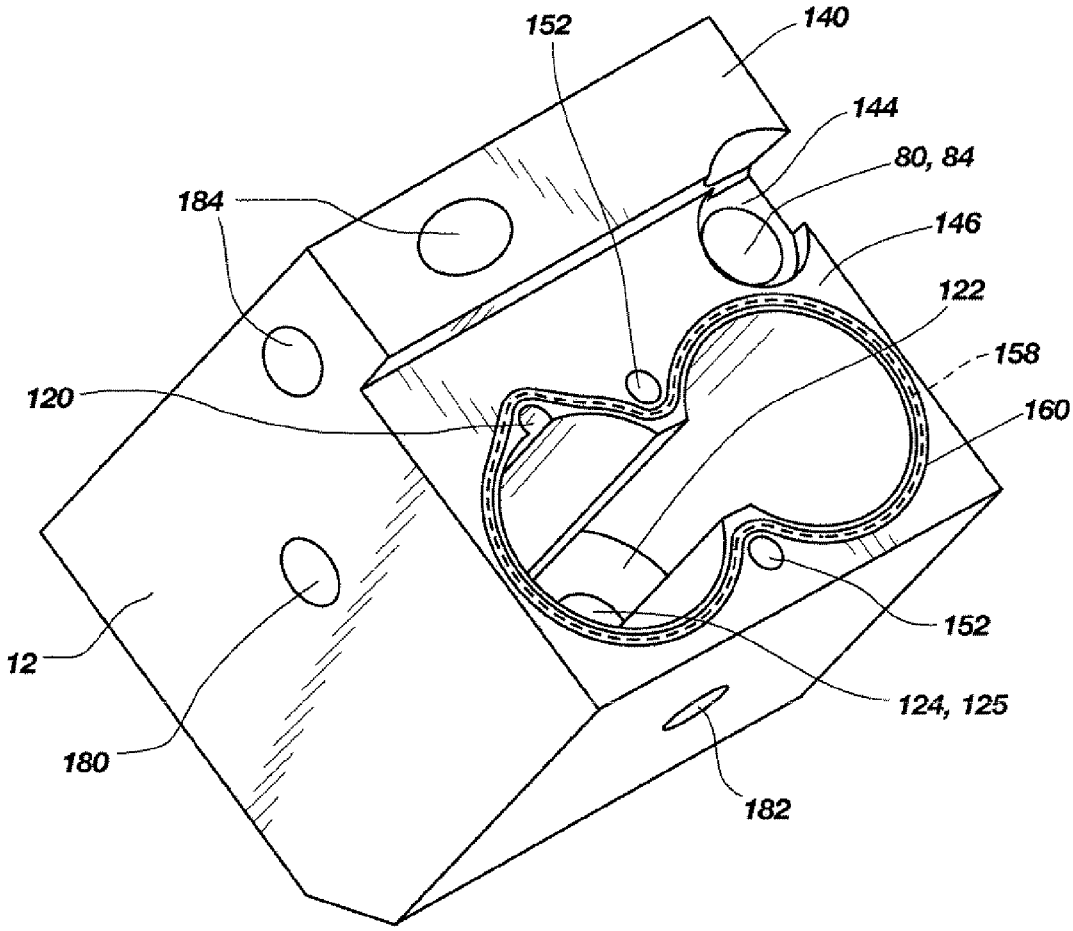
FIG. 4 is an exterior, perspective view of the battery-powered personal light with a lid thereof removed.
Figure 5:
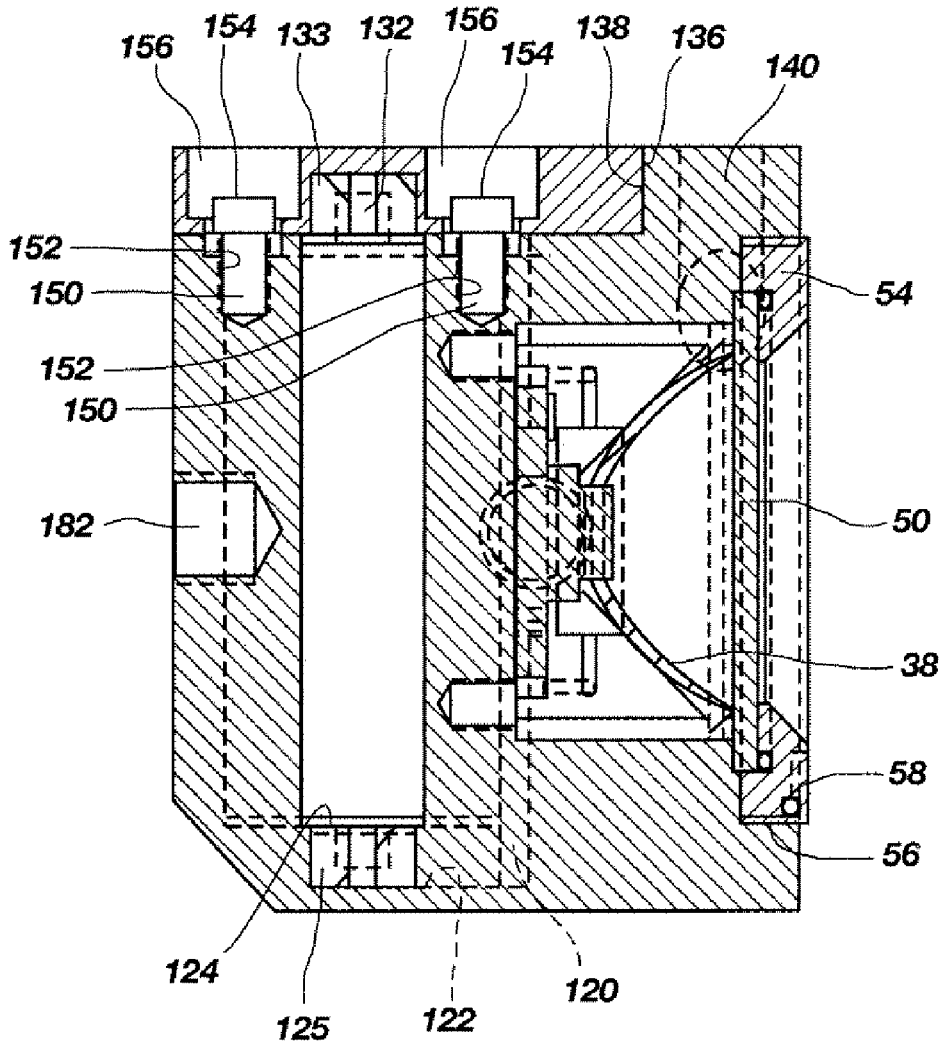
FIG. 5 is a vertical cross-section through the center of the battery-powered personal light, from front to back thereof.

Referring again to FIG. 2, as well as to FIGS. 3, 4 and 5, it may be seen that one of the circular battery bores 14 includes a semicircular wiring chase 120 in the wall thereof, and running parallel thereto to the bottom 122 thereof, where lower battery contacts 124, extending between circular battery bores 14 through aperture 18, are disposed. Lower battery contacts 124 received in insulator tray 125 are laterally electrically connected at 126, and electrically connected in series to LED 34, current-limiting device 40 and switch 42 through wires 128 extending within wiring chase 120 and through feed ports 130 formed between circular battery bore 14 including semicircular wiring chase 120 and cylindrical lighting bore 20. If desired, wire feed ports 130 may be sealed about wires 128 with, for example, silicone or an epoxy to seal off lighting bore 20 from the chamber created by battery bores 14 and aperture 18 therebetween. Wires 128 also extend within semicircular wiring chase 120 upwardly to electrically connect to upper battery contacts 132 which are carried in insulator tray 133 by lid 134, when lid 134 is disposed over housing 12. Both upper and lower battery contacts 132, 124 may be gold plated, for high reliability throughout the life of the battery to which they are connected. Further, spring contacts may be used at one end of each circular battery bore 14, as known to those of ordinary skill in the art to maintain a resiliently biased, impact and vibration-proof connection with the batteries. Wires 128 may extend to upper battery contacts 132 so that lid 134 is physically connected to housing 12, or may terminate at contacts (not shown) which align with resilient contacts (not shown) carried by lid 134 and electrically connected to upper battery contacts 132, as known in the art.

Lid 134 is configured to be self-aligning with housing 12 by engagement of front surface 136 thereof with rear wall 138 of ridge 140 extending across the front of the top of housing 12. Further, substantially annular protrusion 142 on lid 134 is received into circular cutout 144 on the upper surface 146 of housing 12 which lies to the rear of ridge 140, circular cutout 144 (which may extend partially into the rear wall 138) is coaxially aligned with second counterbore portion 84 of switch actuator bore 80. Annular protrusion 142 includes switch actuator rod alignment bore 148 therethrough, which is only slightly larger than end portion 98 of switch actuator rod 90 and receives end portion 98 therein in a non-binding manner when lid 134 is disposed over housing 12. Switch actuator rod alignment bore 148 may include dished or frustoconical mouth portion 149, to better accommodate the digit of a user when pressing end portion 98 of switch actuator rod 90 to its greatest travel. Lid 134 may be affixed to upper surface 146 of housing 12 using fasteners such as screws 150, which engage threaded fastener bores 152 flanking aperture 18, the heads 154 of screws 150 being recessed in enlarged counterbores 156 in the top of lid 134.

To effect a water- and vapor-tight seal between lid 134 and housing 12, a resilient gasket 158 as shown in broken lines formed of a suitable elastomer of the same materials previously referenced herein for O-rings 61 and 65 may be partially received in groove 160 formed in the upper surface 146 of housing 12, gasket 158 being compressed between lid 134 and housing 12 when screws 150 are made up in fastener bores 152. Notably, after lid 134 is assembled with housing 12, end portion 98 of switch actuator rod 90 does not protrude above upper surface 162 of lid 134 so that inadvertent contact therewith may be minimized. Semi-annular recess 164 defined between lid 134 and ridge 140 is of sufficient size to permit a digit of a user's hand, for example a thumb, to depress end portion 98 to activate personal light as described in more detail below.

Current-limiting device 40 may comprise, for example, a resistor or a direct current-limiting regulator integrated circuit, as known in the art, the latter being typically more efficient than the former and providing extended life for LED 34. Further, a current boost circuit as known in the art may also be connected in series with the other components, to provide greater flexibility in battery selection.

Switch 42 may comprise a Hall-type magnetic reed switch or other switch susceptible to actuation using the presence or absence of an adjacent magnetic field.

Batteries 170 which are received in circular battery bores 14 may comprise, by way of example only, commercially available 3V CR123 batteries. The type or number of batteries employed is not critical to practice of the invention. As batteries 170 are connected in series, a 6V power supply may be provided for LED 34. It is specifically contemplated that rechargeable batteries may be employed with personal light 10 and, if so, that an inductively couplable charging mechanism 172 may be disposed, for example, on the underside of lid 134 and wires extended therefrom to batteries 170 may be employed to eliminate the need for opening lid 134 and removing batteries 170 for recharging, thus avoiding any potential for compromising the integrity of resilient gasket 158 over time due to normal wear and tear. To recharge, a charger (not shown) may be placed over personal light 10, or personal light 10 placed in a charger configured with a cradle to receive personal light 10 and align inductively couplable charging mechanism 172 adjacent an inductive charging element of the charger.

Referring again to FIGS. 1, 2 and 4, housing 12 of personal light 10 may include additional features to enhance the utility of the device. For example, threaded accessory bores 180 and 182 may be provided, respectively, in a side surface and a rear surface of housing 12, as well as in a bottom surface thereof (not shown), if desired. Thus, for example, personal light 10 may be used with a belt clip or a carabiner clip (not shown) having a threaded fastener for insertion into an accessory bore 180 or 182, or personal light 10 may be secured to a helmet, a climbing or rescue harness, or a head band or strap using a threaded fastener received in an accessory bore 180 or 182. Similarly, use of a threaded accessory bore in the bottom surface of personal light 10 may enable mounting of personal light 10 to a tripod, staff or other stand. Further, lanyard bore 184 extends obliquely between a top surface of ridge 140 and a side surface of housing 12, as best shown in FIG. 4. Thus, a lanyard, or a length of line or cable, may be used to hang personal light 10 or secure it to the person of a user or to another object. In addition, as may be seen in FIGS. 1A, 1C, 1D, 4, and 5, a chamfer 186 may be cut along the intersection of the rear exterior surface and bottom exterior surface so that personal light 10 may be rested on a flat surface and tilted upwardly at an angle. Chamfer 186 may lie at an angle approaching 45°, the precise angle depending upon the center of gravity of the complete assembly of the personal light 10 containing batteries 170. Of course, a chamfer may be cut at the intersection of three adjoining exterior surfaces of housing 12 and used to orient personal light 10 at an additional, different angle.

As noted above, the light size and shape may be optimized to provide comfort, portability and usefulness to the user due to its convenient size and shape format. For example, the size and shape may provide easy handling of the light in the palm of one's hand. Some or all edges and corners of the light may be chamfered or rounded (radiused) to provide for a comfortable fit into the hand, reducing discomfort when the light is held for long periods and avoiding abrasion of the hand and other skin surfaces. Further, several or all of the exterior surfaces of housing 12 and lid 134 may exhibit a surface treating such as knurling, or a heavy satin finish, to facilitate gripping by a user's hand.

In use, personal light 10 may be activated and deactivated by manipulation of switch actuator rod 90 by the hand of a user. More specifically and by way of example only, the thumb of a user having personal light 10 cradled in the palm of his or her hand may be used to depress end portion 98 of switch actuator rod 90 to place permanent magnets 112 and 114 in lateral proximity to switch 42 to cause, in the case of a Hall-effect-type reed switch, the reed contacts to close and complete an electrical circuit to cause batteries 170 to deliver power to LED 34. Upon depression of end portion 98 to a slight degree against the bias of coil spring 86 (which prevents inadvertent actuation of personal light 10), permanent magnets 112 and 114 are placed in proximity to switch 42 to cause power to flow to LED 34 as switch 42 closes, and release of end portion 98 will cause switch actuator rod 90 to move upwardly and switch 42 to open. However, if end portion 98 is depressed further, the first portion 92 of switch actuator rod 90 will protrude through the bottom surface of housing 12 and resiliently biased detent ball 106 will extend outwardly (see FIG. 1D, wherein biased detent ball 106 has been rotated from the position shown in FIGS. 2 and 3 for clarity and to illustrate that detent ball 106 carried by switch actuator rod 90 may be circumferentially oriented as desired), locking switch actuator rod 90 in place to maintain personal light 10 in an activated mode.

While the present invention has been described in the context of a specific, illustrated embodiment, additions and deletions to, and modifications of, the illustrated embodiment will be readily apparent to those of ordinary skill in the art and are encompassed by the present invention, the scope of which is only limited by the claims which follow.

The invention claimed is:

1. A light, comprising:

a housing including at least one chamber sealed from an environment exterior to the housing;

at least one battery disposed within the at least one chamber and operably coupled to a switch configured for actuation without physical contact therewith, and to an LED disposed within the housing at a location exterior to the at least one chamber and positioned to emit light through an opening in a flat exterior surface of the housing; and a movable switch actuator, carried by the housing exterior to and in isolation from the at least one chamber and selectively movable to actuate and deactuate the switch by placing an actuation element respectively into and out of proximity to the switch.

2. The light of claim 1, wherein the switch comprises a magnetically operable switch, and the actuation element comprises at least one magnet carried by the movable switch actuator.

3. The light of claim 2, wherein the movable switch actuator comprises a rod slidably received in a bore within the housing and axially resiliently biased toward a position wherein the at least one magnet is out of proximity to the switch.

4. The light of claim 3, wherein the bore passes completely through the housing, the rod further comprises an exposed end portion at one end thereof for manual contact thereof, and a detent element resiliently biased transverse to a longitudinal axis of the rod and proximate an opposing end thereof.

5. The light of claim 1, further comprising a current-limiting device operably coupled in series with the at least one battery, the switch and the LED.

6. The light of claim 5, wherein the current-limiting device comprises at least one of a resistor and a direct current-limiting regulator integrated circuit.

7. The light of claim 1, further comprising a reflector operably associated with the LED for focusing light emitted thereby.

8. The light of claim 7, further comprising a lens operably associated with the LED and the reflector.

9. The light of claim 1, wherein the housing is of cuboidal configuration and the LED is positioned for output of light transversely to a face of the cuboidal housing comprising the exterior surface.

10. The light of claim 9, further including at least one flat surface at a back of the cuboidal housing disposed at an acute angle to each of at least two exterior surfaces of the housing.

11. The light of claim 10, wherein the at least one flat surface is placed at an intersection of two mutually perpendicular, adjacent exterior surfaces of the housing or at an intersection of three mutually perpendicular, adjacent exterior surfaces of the housing.

12. The light of claim 10, wherein an angle of the at least one flat surface is selected in relation to a center of gravity of the light to enable the light to balance thereon when placed on a substantially flat support surface.

13. The light of claim 9, further comprising at least one threaded bore on at least one face of the cuboidal housing, the at least one threaded bore configured for receiving a cooperatively configured fastener associated with at least one of a stand, a tripod, a staff, a helmet, a harness, a headband, a carabiner and a clip thereto.

14. The light of claim 9, further comprising a hole extending obliquely through a solid portion of the housing between a first exterior surface thereof and a second exterior surface thereof.

15. The light of claim 9, wherein at least some edges and corners of the housing are chamfered or radiused.

16. The light of claim 1, further comprising a lid disposed over a surface of the housing other than the flat exterior surface having the opening therein and providing, in combination with the housing, a seal for the at least one chamber.

17. The light of claim 16, wherein the lid is configured to self-align with the housing when disposed thereover.

18. The light of claim 16, wherein the housing comprises a recess and the lid comprises a cooperatively configured protrusion at least partially received therein.

19. The light of claim 16, further including a recess in the lid and a bore in the lid opening into the recess, and wherein:

the switch comprises a magnetically operable switch, and the actuation element comprises at least one permanent magnet carried by the movable switch actuator, which is configured as a rod;

the rod is slidably received in a switch actuator bore passing completely through the housing, aligned with the bore of the lid and isolated from the at least one chamber, wherein the rod is axially resiliently biased toward a position wherein the at least one permanent magnet is out of proximity to the switch; and the rod further comprises an exposed end portion at one end thereof extending through the bore of the lid and exposed within the recess of the lid for manual contact thereof, and a detent element resiliently biased transverse to a longitudinal axis of the rod and proximate an opposing end thereof.

20. The light of claim 19, wherein:

the at least one permanent magnet comprises two permanent magnets;

the rod is formed in two axially aligned segments, each segment of the rod carrying, at an end thereof, one of the two permanent magnets and providing a portion of a magnet chamber wherein the two permanent magnets are disposed in mutual proximity; and wherein the two segments of the rod are held together by magnetic fields provided by the two permanent magnets.

21. The light of claim 1, wherein the housing is substantially cuboidal, the LED is disposed within a bore opening onto a face of the housing, and further comprising:

a reflector operably associated with the LED and extending toward the face of the housing therefrom;

a lens having an anti-reflective coating thereon disposed over an end of the reflector and proximate the face; and an annular lens cap disposed over the lens and threaded to the housing proximate the face.

22. The light of claim 21, wherein the annular lens cap includes a plurality of generally radially extending slots in an exterior surface thereof.

* * * * *